US005630503A

United States Patent [19]

Rhodes et al.

[11] Patent Number: 5,630,503

[45] Date of Patent: May 20, 1997

[54] COMBINATION CIGARETTE PACK AND LIGHTER HOLDER

[76] Inventors: Kenneth Rhodes; Nancy Rhodes, both of 109 W. Lake Mead Dr., Henderson, Nev. 89015

[21] Appl. No.: 567,435

[22] Filed: Dec. 5, 1995

[51] Int. Cl.[6] ..... B65D 85/10

[52] U.S. Cl. ..... 206/85; 206/256; 206/259

[58] Field of Search ..... 206/85–95, 236, 206/256, 259; 220/501–503, 505, 523–527

[56] References Cited

U.S. PATENT DOCUMENTS

| | | | |
|---|---|---|---|
| D. 260,689 | 9/1981 | Storms | D27/37 |
| 2,458,923 | 1/1949 | Auten | 206/95 |
| 2,494,724 | 1/1950 | Schmidt | 206/95 |
| 2,506,832 | 5/1950 | Henson | 206/92 |
| 3,069,886 | 12/1962 | Coats | 67/7.1 |
| 4,000,812 | 1/1977 | Pisarski et al. | 206/87 |
| 4,230,224 | 10/1980 | Weeks | 206/87 |
| 4,852,729 | 8/1989 | Conte | 206/86 |

*Primary Examiner*—Jimmy G. Foster
*Attorney, Agent, or Firm*—Joseph N. Breaux

[57] ABSTRACT

A combination cigarette pack and lighter holder of the type having a base member insertable within a top member is provided. The combination cigarette pack and lighter holder comprises: a base member having a first section defining a cigarette compartment adapted for disposing a cigarette pack therein and a second section defining a lighter compartment adapted for disposing a cigarette lighter therein, the second section being substantially centered along the vertical axis of the front wall of the first section and extending outwardly therefrom; and a top member adapted for removably inserting the base section therein, in a manner such that the cigarette pack and lighter are contained within the combination cigarette pack and lighter holder.

1 Claim, 1 Drawing Sheet

COMBINATION CIGARETTE PACK AND LIGHTER HOLDER

TECHNICAL FIELD

The present invention relates to devices for holding a pack of cigarettes and a lighter and more particularly to devices for holding a pack of cigarettes and a lighter that have a base member removably insertable into a top member.

BACKGROUND ART

All cigarette smokers encounter the frustrating problem of reaching for a cigarette only to find that they do not have a lighter to light the cigarette. The lighter either being lost or located in another location.

Cigarette smokers often store cigarettes in a pocket, purse or jacket. Smokers also tend to store cigarettes in a vehicle's glove box, or on the car seat. Due to the delicate nature of cigarettes and the variety of locations in which they are stored, smokers often find that their cigarettes have been crushed or have absorbed excess moisture.

It would be a benefit, therefore, to have a device that holds a pack of cigarettes and a lighter in a single container. It would be a further benefit, to have a device for holding a cigarette pack and a lighter that is substantially rigid to protect the contained cigarettes. It would be an additional benefit, to have a device for holding a cigarette pack and a lighter within a base member which is insertable into a top member to protect the cigarettes from being crushed and from absorbing excess moisture.

GENERAL SUMMARY DISCUSSION OF INVENTION

It is thus an object of the invention to provide a combination cigarette pack and lighter holder that has a base member having a first section adapted for holding a pack of cigarettes and a second section adapted for holding a cigarette lighter.

It is a further object of the invention to provide a combination cigarette pack and lighter holder that has a substantially rigid base member having a first section adapted for holding a pack of cigarettes and a second section adapted for holding a cigarette lighter.

It is a still further object of the invention to provide a combination cigarette pack and lighter holder that has a substantially rigid base member having a first section adapted for holding a pack of cigarettes and a second section adapted for holding a cigarette lighter, wherein, the first and second sections form a substantially planar, open top surface.

It is a still further object of the invention to provide a combination cigarette pack and lighter holder that has a top member adapted for removably inserting the base member therein, enclosing the pack of cigarettes and lighter.

Accordingly, a combination cigarette pack and lighter holder of the type having a base member insertable within a top member is provided. The combination cigarette pack and lighter holder comprises: a base member having a first section defining a cigarette compartment adapted for disposing a cigarette pack therein and a second section defining a lighter compartment adapted for disposing a cigarette lighter therein, the second section being substantially centered along the vertical axis of the front wall of the first section and extending outwardly therefrom; and a top member adapted for removably inserting the base section therein, in a manner such that the cigarette pack and lighter are contained within the combination cigarette pack and lighter holder.

The base member may be constructed of a flexible material, such as rubber, cloth or leather, so that it may be folded and stored when not in use. Preferably, the base member is constructed of a rigid material such as plastic or aluminum to protect the cigarettes and lighter stored therein. The top member is constructed of the same material as the base member.

The base member may be integrally constructed as one piece. The second section of the base member may be fixedly connected to the front wall. Preferably, the open end of the second section is in a parallel plane formed by the open top surface of the first section.

The height of the first section of the base member is a predetermined distance shorter than the height of the cigarette pack it is intended to hold. The height will be determined as to whether or not the cigarettes are king-size, regular size, or have flip top boxes. The height of the cigarette compartment defined by the first section is determined such that a portion of the pack extends above the top surface of the base member to facilitate removing the pack. In the case of a flip top box, the height of the first section of the base member should not be higher than the front opening line of the flip top box.

The second section of the base member is sized to dispose a cigarette lighter. Preferably, the lighter compartment defined by the second section is sized so as to frictional engage the cigarette lighter. In addition, the lighter compartment is sized so that the operational head of the lighter extends above the top surface of the base section.

For each base member having a first section sized to dispose a king-size or regular size cigarette pack is a separate embodiment having a second section adapted for disposing either a disposable type cigarette lighter or a refillable fuel type lighter.

The top member is sized to removably dispose the base member therein. With the base member inserted within the top member, the bottom edge of the top member may be substantially aligned with the bottom wall of the base member. In this case the top member may form a pair of recesses on opposed walls so that a user may grasp the base member for removal. Preferably, when the base member is inserted into the top member the bottom of the top member is substantially aligned with the floor wall of the first section.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
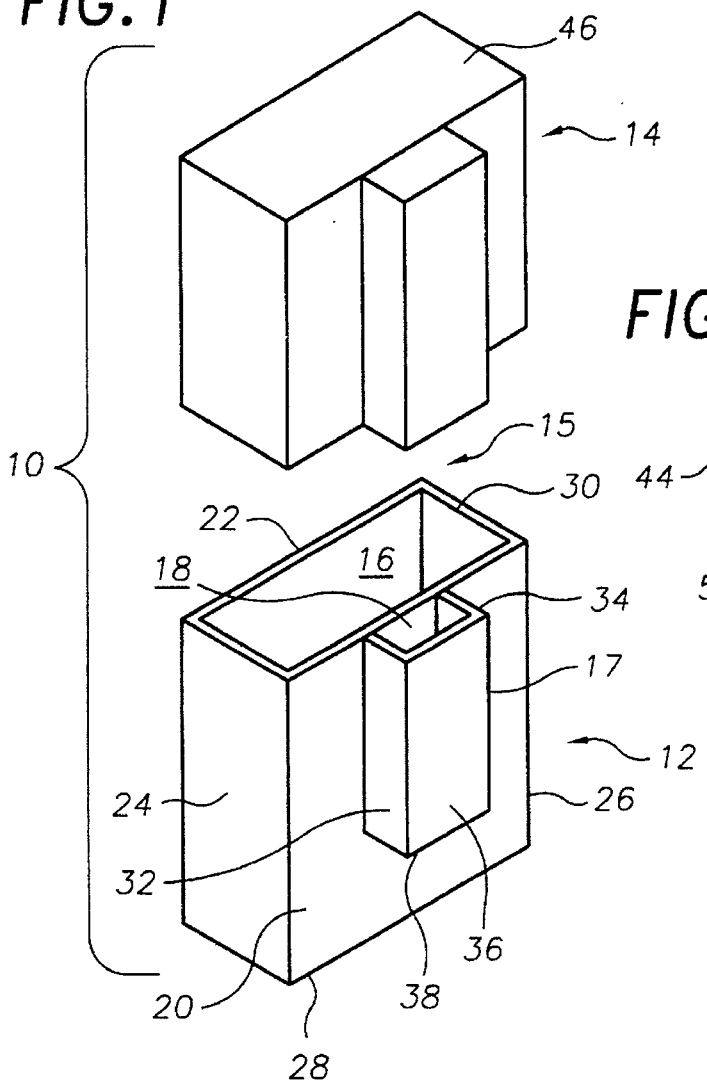
FIG. 1 is a perspective view of an exemplary embodiment of the combination cigarette pack and lighter holder of the present invention.

FIG. 1 is a perspective view of an exemplary embodiment of the combination cigarette pack and lighter holder of the present invention generally designated by the numeral 10. Holder 10 comprises a base member 12 frictionally insertable into a top member 14. Base member 12 is integrally formed of a substantially rigid plastic as one piece having a first section 15 defining a cigarette compartment 16 and a second section 17 defining a lighter compartment 18.

First section 15 has a front wall 20, a rear wall 22, a left side wall 24, a right side wall 26 and a bottom wall 28. Front wall 20 and rear wall 22 are parallel to one another and interconnect side walls 24, 26 and bottom wall 28 to form a five sided box defining cigarette compartment 16.

The second section 17 of base member 12 includes a first side wall 32, a second side wall 34, a cover wall 36 and a floor wall 38. Side walls 32, 34 are spaced from one another and extend perpendicularly outward from front wall 20. Cover wall 36 is substantially perpendicular to front wall 20 and interconnects side walls 32 and 34. Floor wall 38 extends perpendicularly from front wall 20 and interconnects side walls 32, 34 and cover wall 36.

Second section 17 is centered along the vertical axis of front wall 20. First section 15 and second section 17 form a substantially planar, open top surface 30 substantially parallel to bottom wall 28.

Figure 2:
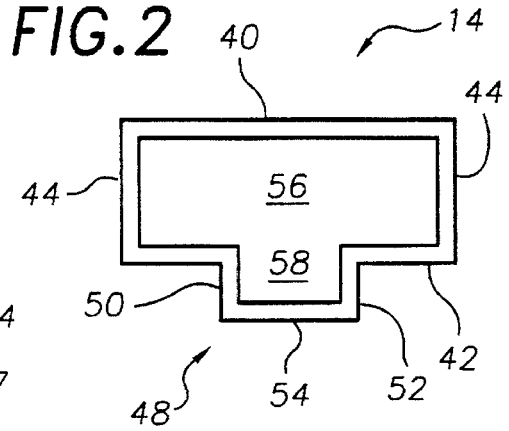
FIG. 2 is a bottom view of the top member.

FIG. 2 is a bottom view of top member 14. Top member 14 is integrally formed of a substantially rigid plastic as one piece. Top member 14 has a first wide wall 40, a second wide wall 42, a pair of narrow walls 44 and a top wall 46 (FIG. 1). First and second wide walls 40, 42 are substantially parallel to one another and interconnect narrow walls 44 and top wall 46. Wide walls 40, 42, narrow walls 44 and top wall 46 define a base receptacle 56 having a channel portion 58.

Second wide wall 42 has a U-shaped section 48 formed approximate the midpoint thereof extending away from first wide wall section 40. U-shaped section 48 includes a first and second leg 50, 52 extending perpendicularly outward from second wide wall 42 and parallel to one another. A third leg 54 interconnects first and second legs 50, 52 and is substantially parallel to first wide wall 40. U-shaped section 48 defines channel portion 58 of base receptacle 56.

Figure 3:
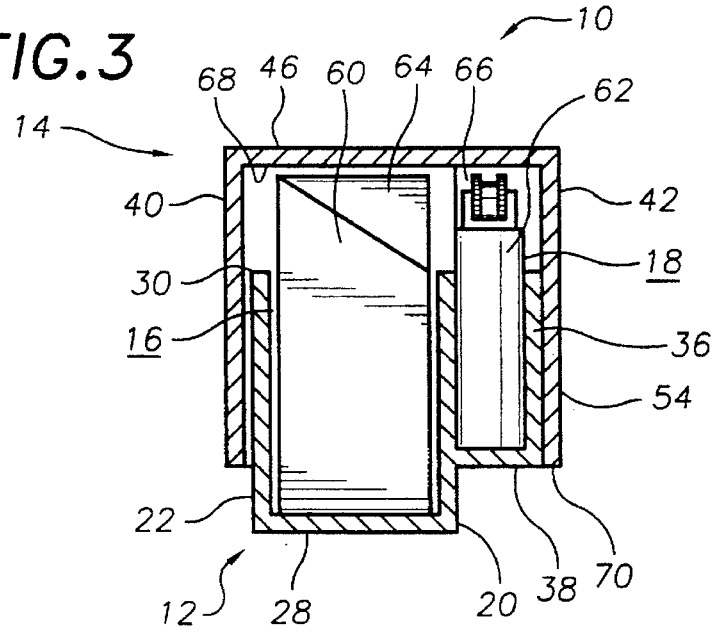
FIG. 3 is a partial cross-sectional, side view of the combination cigarette pack and lighter holder.

FIG. 3 is a partial cross-sectional, side view of combination cigarette pack and lighter holder 10. As shown in FIG. 3, a pack of cigarettes 60 and a disposable butane cigarette fighter 62 are disposed within base member 12. Base member 12 is frictionally disposed within top member 14.

Cigarette pack 60 is disposed within cigarette compartment 16 formed by base member 12. Cigarette compartment 16 is sized so as to hold cigarette pack 60 in frictional engagement. Front wall 20 and rear wall 22 of base member 12 are identical in size. Front and rear walls 20, 22 extend above bottom wall 28 a distance, such that, when cigarette pack 60 is disposed against bottom wall 28 a portion thereof extends above top surface 30 of base member 12 for easily removing pack 60 therefrom. Compartment 16 is sized so that when cigarette pack 60 has a flip top 64, as shown, flip top 64 extends above top surface 30.

Lighter compartment 18 is sized so as to hold cigarette lighter 62 in frictional engagement. Cover wall 36 extends downwardly from top surface 30 to floor wall 38 a distance, such that, when lighter 62 is disposed within compartment 18 the operational head 66 of lighter 62 extends above top surface 30.

First and second wide walls 40, 42 of top member 14 are identical in height and width. Top member 14 is sized such that when base member is disposed within top member 14 an inner surface 68 of top wall 46 contacts cigarette pack 60. When inner surface 68 contacts pack 60 the bottom edge 70 of third leg 54 is substantially aligned with floor wall 38 of base member 12.

Use of combination cigarette pack and lighter holder 10 is now described with reference to FIGS. 1 through 3. A pack of cigarettes 60 is disposed within cigarette compartment 16 defined by first section 15 of base member 12. Compartment 16 is sized so that a portion of pack 16 extends above top surface 30 of base member 12. Compartment 16 is sized so that when a pack of cigarettes 60 having a flip top 64 is disposed therein, flip top 64 extends above top surface 30. A cigarette lighter 62 is disposed within lighter compartment 18 defined by second section 17 of base member 12. Compartment 18 is sized so that the operational head 66 of lighter 62 extends above top surface 30 so that lighter 62 may be removed from compartment 18 or operated therefrom.

Top member 18 defines a base receptacle 56 having a channel portion 58. Top member 18 is shaped to slidably dispose base member 12 therein with second section 17 being disposed within channel portion 58. Base member 12, containing cigarette pack 60 and lighter 62, is frictionally disposed within top member 14 for storing and protecting pack 60 and lighter 62.

It can be seen from the preceding description that a device for holding a pack of cigarettes and a lighter which has a base member having a first section adapted for holding a pack of cigarettes and a second section adapted for holding a cigarette lighter, has a substantially rigid base member, has a substantially rigid base member having a first section adapted for holding a pack of cigarettes and a second section adapted for holding a cigarette lighter, wherein, the first and second sections form a substantially planar, open top surface and has s top member adapted for removably inserting the base member therein, containing the pack of cigarettes and lighter therebetween has been provided.

It is noted that the embodiment of the combination cigarette pack and lighter holder described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A combination cigarette pack and lighter holder comprising:

a base member having a first section and a second section; said first and said second sections being integrally formed from substantially rigid plastic, said first section having a front wall, a rear wall, a left side wall, a right side wall and a bottom wall, said front wall and said rear wall being parallel to one another and interconnecting said left side wall, said right side wall and said bottom wall in a manner to form a five sided box defining a cigarette compartment; said second section having a first side wall, a second side wall, a cover wall and a floor wall, said first and said second side wall being spaced from one another and extending perpendicularly outward from said front wall of said first section approximate the midpoint thereof, said cover wall being substantially parallel to said front wall and interconnecting said first side wall, said second side wall and said floor wall, said floor wall extending substantially perpendicularly from said front wall and interconnecting said first and said second side wall and said cover wall, said second section defining a lighter compartment, said first section and said second section of said base member forming a substantially planar, open top surface; and a top member adapted for removably inserting said base section therein in a manner such that the said cigarette pack and said lighter are enclosed therein, said top member having a first wide wall, a second wide wall, a pair of narrow side walls and a top wall, said first wide wall, said second wide wall, said pair of narrow side walls and said top wall being integrally formed of rigid plastic, said first and said second wide walls being substantially parallel to one another and interconnecting said pair of narrow walls and said top wall, said second wide wall of said top member having a U-shaped section, said U-shaped section having a first leg, a second leg and a third leg, said first and said second leg extending perpendicularly outward from said second wide wall and substantially parallel to one another, said third leg interconnecting said first and said second leg and being substantially parallel to said first wide wall, said base member being insertable within said top member said second section of said base member being disposed within a channel formed by said U-shaped section of said top section.

* * * * *